United States Patent [19]

Bachner

[11] Patent Number: 4,601,425

[45] Date of Patent: Jul. 22, 1986

[54] NONWICKING BOTTOM CLOSURE FOR A LIQUID-TIGHT CONTAINER

[75] Inventor: Larry G. Bachner, Barrington, Ill.

[73] Assignee: Nimco Corporation, Crystal Lake, Ill.

[21] Appl. No.: 584,869

[22] Filed: Feb. 29, 1984

[51] Int. Cl.[4] ..... B65D 5/72

[52] U.S. Cl. ..... 229/17 G; 229/114; 229/139; 229/184

[58] Field of Search ..... 229/17 B, 17 G, 25, 229/37 R, 38, 43, 44 R, 5.5

[56] References Cited

U.S. PATENT DOCUMENTS

| | | | |
|---|---|---|---|
| 3,118,586 | 1/1964 | Kelly | 229/17 G |
| 3,239,126 | 3/1966 | Arslanian | 229/3.5 |
| 3,269,644 | 8/1966 | Bump | 229/17 G |
| 3,294,310 | 12/1966 | Miller et al. | 229/48 |
| 3,412,922 | 11/1968 | Miller et al. | 229/17 G |
| 3,498,524 | 3/1970 | Braun | 229/17 G |
| 3,770,185 | 11/1973 | Reeves | 229/17 G |
| 4,012,997 | 3/1977 | Bachner et al. | 93/36.8 |
| 4,113,168 | 9/1978 | Shirakawa | 229/37 |
| 4,124,159 | 11/1978 | Schwarzkopf | 229/17 G |
| 4,192,446 | 3/1980 | Naito | 229/37 R |
| 4,206,867 | 6/1980 | Skjelby | 229/17 G |
| 4,211,357 | 7/1980 | Lisiecki | 229/17 G |
| 4,281,787 | 8/1981 | Hensey | 229/17 G |
| 4,394,954 | 7/1983 | Lisiecki | 229/17 G |

FOREIGN PATENT DOCUMENTS

| | | |
|---|---|---|
| 416008 | 10/1934 | United Kingdom . |
| 732682 | 6/1955 | United Kingdom . |
| 512045 | 10/1959 | United Kingdom . |

*Primary Examiner*—Joseph Man-Fu Moy

*Attorney, Agent, or Firm*—Kirkland & Ellis

[57] ABSTRACT

A new carton blank configuration and a method of folding it to provide a liquid-tight, nonwicking carton or container bottom is disclosed. The scoring pattern and bottom panel configuration of the carton make possible the formation of a carton bottom having no exposed edges of the carton blank on the inside of the container without folding or slitting any bottom panel prior to the carton folding and sealing process. The carton blank is shaped and scored for folding and is substantially a flat container bottom. An extension tab extending from one of the two bottom panels allows for a nonwicking surface to be formed and tucked into the interior of the carton bottom during the bottom-forming process as the edges of the two bottom panels contact each other. The inside surface of the bottom panel not having an extension tab contacts the extension tab, folding the extension tab back along a score line. As the two bottom panels move closer together, the bottom panel with the extension tab is tucked under the other bottom panel, and the folded surface of the extension tab covers the gap between the various bottom panels of the carton bottom, leaving no exposed edges on the interior of the carton.

17 Claims, 14 Drawing Figures

FIG. 1
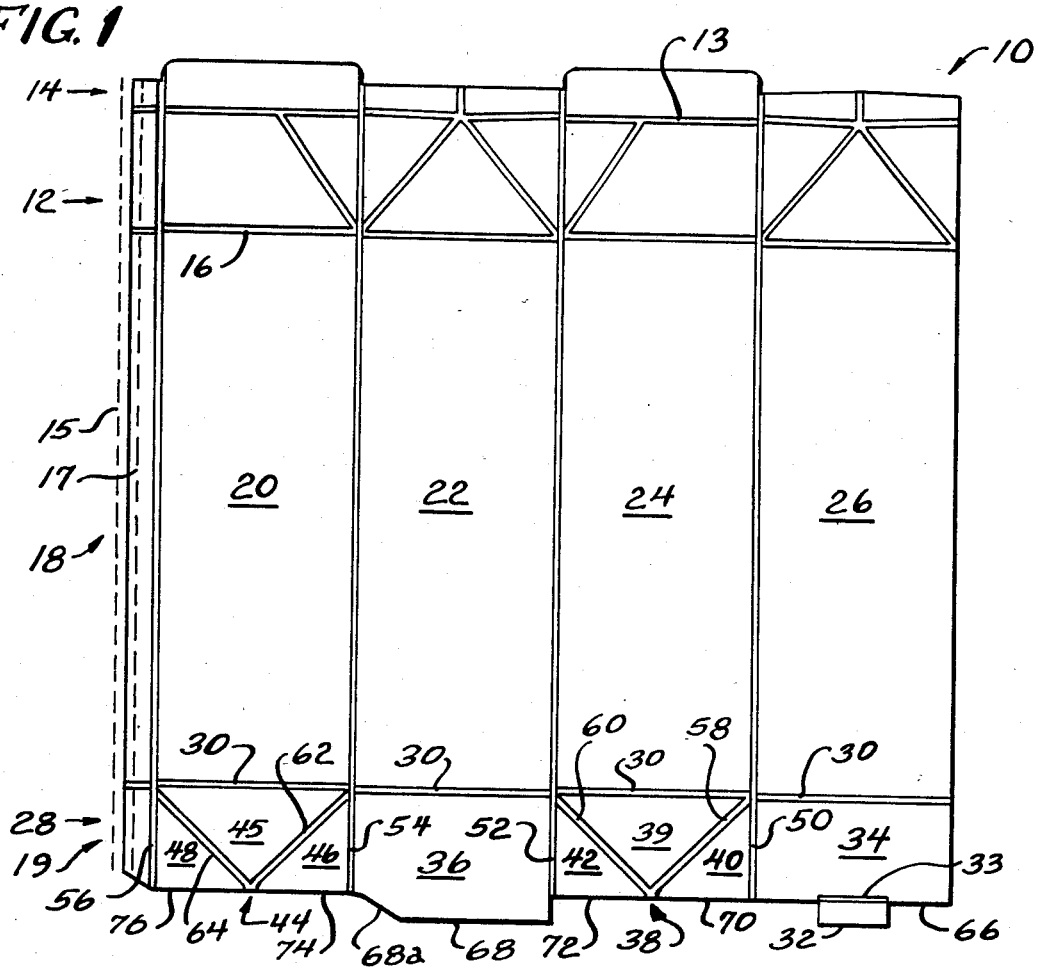
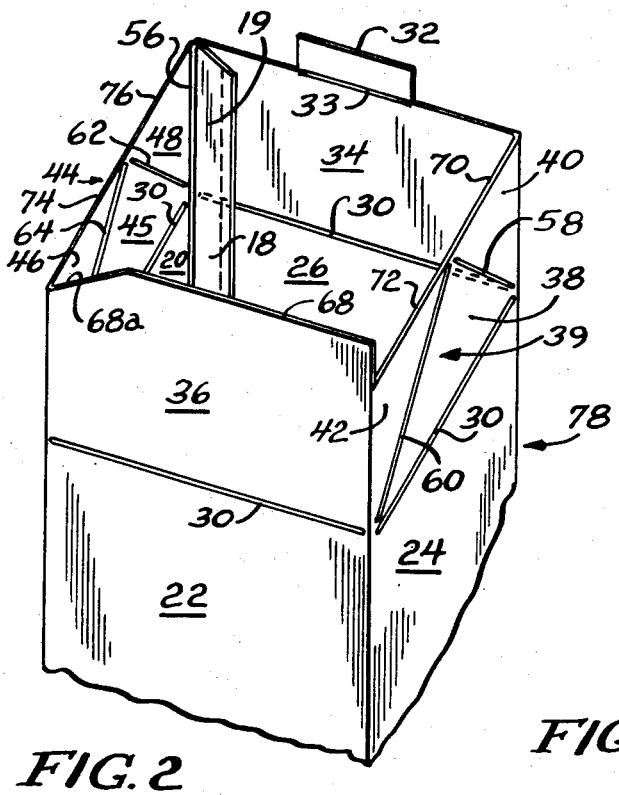
FIG. 2
FIG. 3
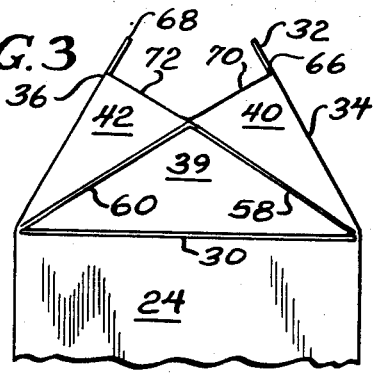
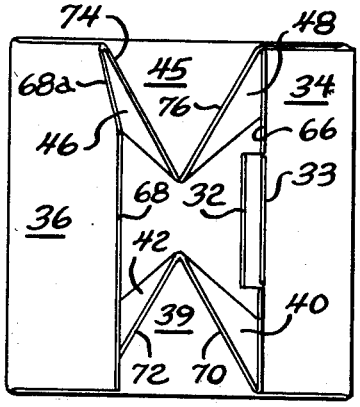
FIG. 3a

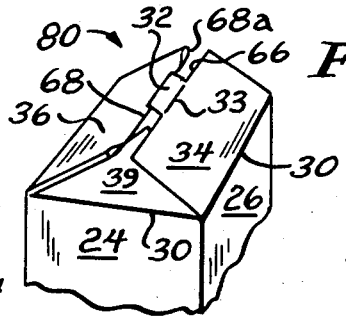
FIG. 4a
FIG. 4
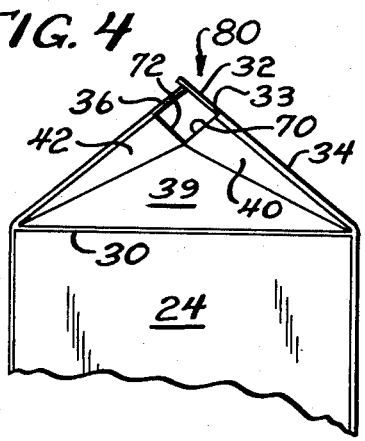
FIG. 5
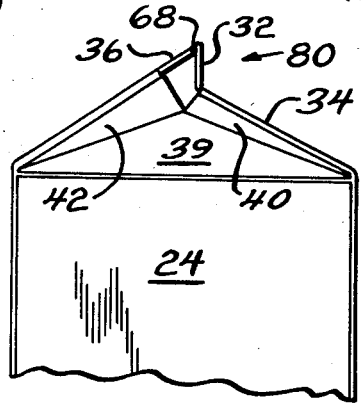
FIG. 5a
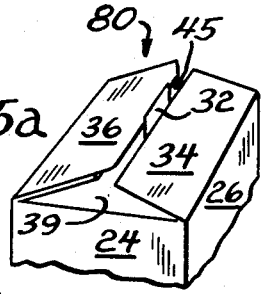
FIG. 6
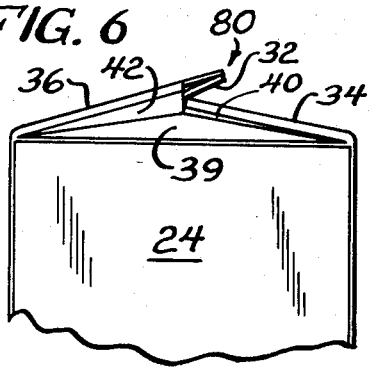
FIG. 7
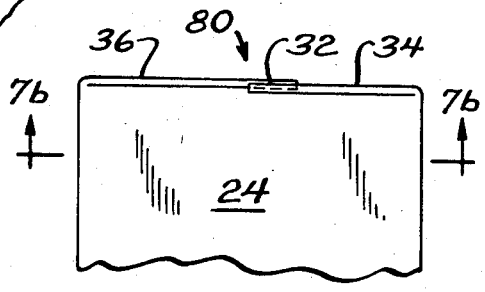
FIG. 7a
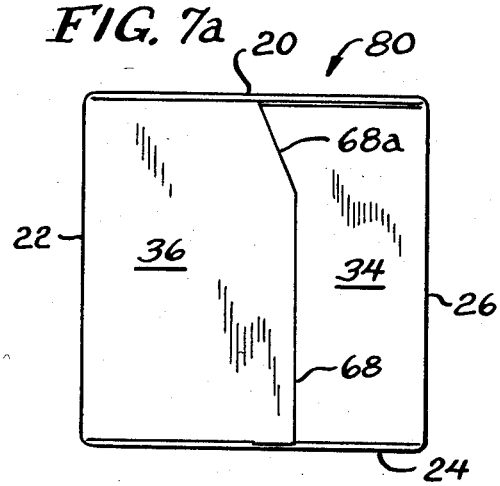
FIG. 7b
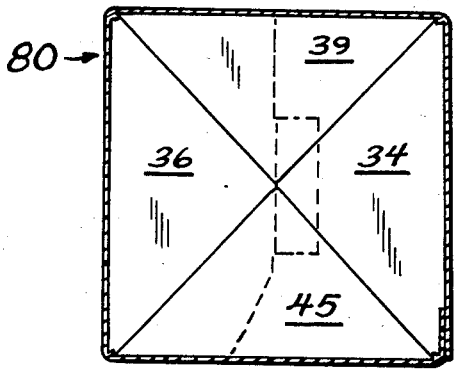

NONWICKING BOTTOM CLOSURE FOR A LIQUID-TIGHT CONTAINER

BACKGROUND OF THE INVENTION

1. Field of the Invention

This invention relates to paperboard containers and more particularly to liquid-tight paperboard containers, examples of which are disposable containers adapted for distribution of beverages, milk and other dairy products, which eliminate edge wicking through exposed panel edges in the interior of the container.

2. Description of the Prior Art

Paperboard containers are widely used in the dairy and other industries to package milk and other liquids and substances. Because these containers are formed from blanks cut from large paperboard sheets, there are raw or open edges along the cut lines which are subject to wicking or penetration by the product within the container. In the past this edge wicking problem was avoided by folding under the open edges or cut lines along the full length of the side seam and the bottom tuck panel of the container so as to provide no exposed panel edges in the side or bottom interior of the container, thereby rendering the carton impervious to liquids stored therein. Such a method for folding under the entire edge of one bottom panel is disclosed in U.S. Pat. No. 3,294,310 to Miller, issued Dec. 27, 1966. The sealing the interior of the carton due to the build up of paperboard thicknesses along portions of the interior seal, which creates an inherent channel area that is difficult to seal effectively. In addition, the Miller method necessitates use of a carton blank having an oversize bottom panel.

An improved method is disclosed in U.S. Pat. No. 3,412,922 to Miller, issued Nov. 26, 1968, in which two parallel slits are made in the end of one bottom panel and the tab or portion of the panel between the slits is folded back. Only the folded-back tab thereby formed is inserted into the interior of the bottom closure so as to present no open edge in the interior of the container.

Thus, with the method described in the Miller U.S. Pat. No. 3,412,922 it is necessary to fold under the entire open edge of the bottom tuck panel. The method described in the Miller U.S. Pat. No. 3,412,922 requires slits to made in the bottom tuck panel before and the portion of the panel between the slits to be folded under during forming and sealing the bottom.

The present invention provides a new carton blank configuration which permits the formation of a nonwicking bottom for liquid containers without folding or slitting the bottom tuck panel before beginning the bottom forming and sealing process.

SUMMARY OF THE INVENTION

The present invention comprises a new carton blank with a unique bottom panel configuration. Except for the bottom panel configuration of the present invention, the carton blank can be the same as for any type of carton requiring a closed bottom, including, but not limited to, cartons shaped as sections of round cylinders, square cylinders, rectangular cylinders, and cones and cartons having four trapezoidal shaped wall panels. The carton blank of the present invention is made of a plastic coated paperboard or other suitable material and is related to conventional prior art carton blanks, both nonwicking and other types, using four bottom panels except for the addition of an extension tab connected by a score line to the bottom tuck panel. This eliminates the need for a score line along the entire length of the bottom tuck panel or for any slits in the bottom tuck panel. In the present invention, the score line between the bottom tuck panel and the extension tab permits the extension tab to be folded under during, rather than prior to, the bottom forming process, providing no exposed edges on the interior of the container.

To create a paperboard container having a nonwicking bottom from a carton blank of the present invention, the carton blank first is folded and sealed to form a rectangular, tubular body in a conventional manner. A force is then directed against a triangular end tab on each of two scored end panels of the bottom portion of the carton blank, causing the triangular end tabs to be folded inward, toward the center of the rectangular body. As additional force is applied, the two triangular fold-in tabs on each of the two end panels also collapse in toward the center. Another force is directed against each of two bottom panels, causing them to be folded toward the center of the rectangular body. At the same time, the interior surfaces of these triangular fold-in tabs leave a gap between where they meet at the center of the carton. As the two bottom panels are folded closer toward the center, the extension tab contacts the outside edge of the other bottom panel, causing the extension tab to be folded back along the score line. The folded-back surface of the extension tab is tucked into the gap between the two triangular fold-in tabs. Once the bottom tuck panel and its extension tab have been tucked under the other (outer) bottom panel, additional force is applied to the other bottom panel until both bottom panels and both end panels are folded down to form a flat carton bottom.

Therefore, it is an object of the present invention to simplify the steps required to fold the bottom panels for sealing without having exposed edges on the container interior.

It is a further object of the present invention to provide a nonwicking container bottom without requiring slits to be made in the bottom tuck panel.

It is another object of the present invention to preserve the beneficial features of the nonwicking bottom closure configuration while providing a method of formation which involves neither folding nor slitting the bottom tuck panel prior to commencing the bottom-forming process.

Another object of the present invention is to provide a bottom panel member configuration which permits the extension tab on the bottom tuck panel to be folded under during the bottom-forming process to provide a non-wicking surface on the carton bottom.

Other objects and advantages of the present invention will be apparent from the following descriptions and accompanying drawings of the preferred embodiment of the present invention.

BRIEF DESCRIPTION OF THE DRAWINGS

In the Drawings

FIG. 1 is a top plan view of the interior of the carton blank of the preferred embodiment of the present invention;

FIG. 2 is a perspective view of the bottom closure of the present invention after formation of the rectangular body and before the bottom closure members are folded from their initial flat positions;

FIG. 3 is a side view of the bottom closure after bottom panel 36 and bottom tuck panel 34 have been folded toward the center of the carton body;

FIG. 3*a* is a top view of the bottom closure in the partially folded position shown in FIG. 3;

FIG. 4 is a side view of the bottom closure after the bottom panel 36 and the bottom tuck panel 34 have been folded toward the center of the carton body far enough for the extension tab 32 to contact the bottom panel 36;

FIG. 4*a* is a perspective view of the bottom closure in the partially folded position shown in FIG. 4;

FIG. 5 is a side view of the bottom closure after the bottom panel 36 and the bottom tuck panel 34 have been folded toward the center of the carton body far enough for the extension tab 32 to be partially folded back by contact with the bottom panel 36;

FIG. 5*a* is a perspective view of the bottom closure in the partially folded position shown in FIG. 5;

FIG. 6 is a side view of the bottom closure with the bottom panel 36 and bottom tuck panel 34 folded farther toward the center of the carton body than in FIGS. 5 and 5*a;*

FIG. 7 is a side view of the bottom closure with the bottom panel 36, the bottom tuck panel 34 and the extension tab 32 in the final, folded-flat position;

FIG. 7*a* is a top view of the bottom closure in the final, folded-flat position shown in FIG. 7;

FIG. 7*b* is a bottom view, looking from the interior of the carton, of the bottom closure in the final, folded-flat position.

DETAILED DESCRIPTION OF THE PREFERRED EMBODIMENT

Figure 8:
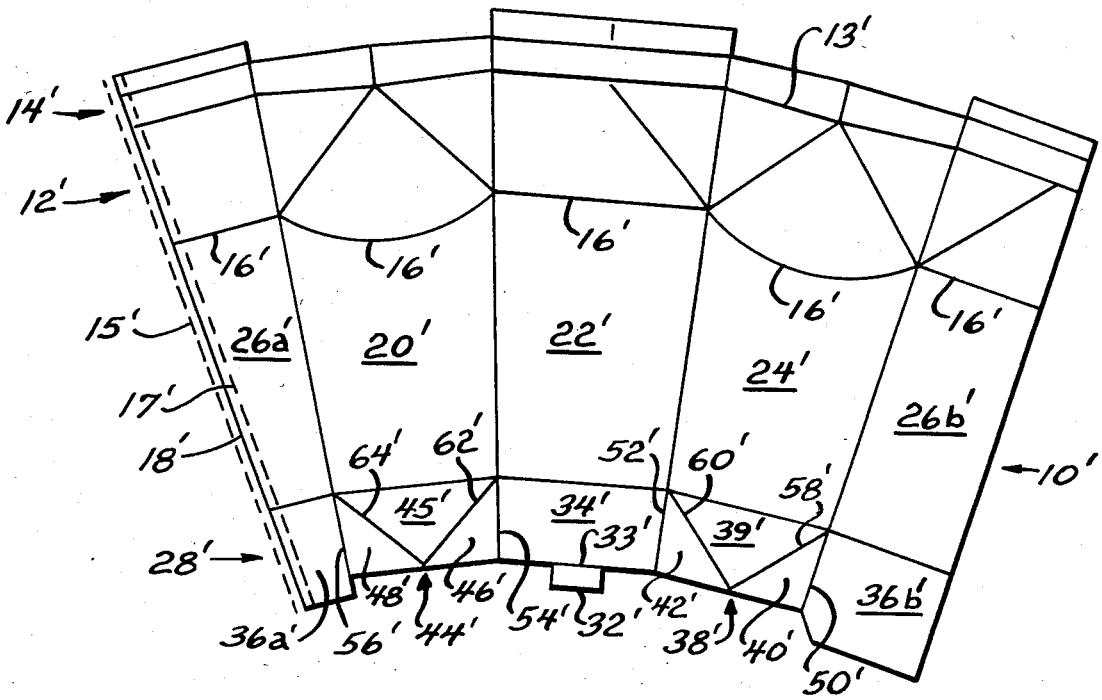
FIG. 8 is a top plan view of the interior of the carton blank of an alternative embodiment of the present invention.

Referring to FIG. 1, carton blank 10 is made of a plastic coated paperboard or other suitable material and comprises rectangular wall panels 20, 22, 24 and 26, conventional top closure panels 12, each of which is connected along a fold line 13 to top sealing tabs 14. Top closure panels 12 and top sealing tabs 14 can be of any configuration suitable for the configuration of the wall panel structure employed. For some applications the top structure could be omitted and an open top provided. Wall panels 20, 22, 24 and 26 are connected to the bottom closure of carton blank 10 along score line 30. Side seam panel 18 is connected to wall panel 20 and the associated top closure panel 12 and bottom closure 28. Side seam panel 18 and side seam bottom panel 19 have score lines 15 and 17 which permit these panels to be folded under and sealed to form a nonwicking side seam, as disclosed, for example, in U.S. Pat. No. 3,294,360 to Miller, et al., which issued Dec. 27, 1966.

The present invention is directed to the bottom closure 28 of the carton end. Accordingly the top closure panels 12 and tabs 14 along with side seam panel 18 and wall panels 20, 22, 24 and 26 are conventional and are not part of the present invention. Bottom closure 28 of the carton blank 10 may be adapted for use with any one of a number of known carton side or wall and top configurations. A satisfactory top closure and wall panel configuration and scoring pattern is disclosed in FIG. 1 of U.S. Pat. No. 4,093,115 to Bachner issued June 6, 1978, which is assigned to the same assignee as the present invention. Bottom closure 28, comprising those portions of carton blank 10 lying below score line 30 has a peripheral shape substantially similar to that shown in FIG. 1 of U.S. Pat. No. 3,412,922 to Miller issued Nov. 26, 1968, except for the addition of extension tab 32 to bottom tuck panel 34, as described below.

Carton bottom closure 28 is bounded on the top by score line 30 and includes side seam bottom panel 19, bottom tuck panel 34, bottom panel 36, bottom end panel 38 and bottom end panel 44. Side seam bottom panel 19 is connected to wall panel 20 along score line 30 and to bottom end panel 44 along score line 56. Bottom tuck panel 34 is connected to wall panel 26 along score line 30 and to bottom end panel 38 along score line 50. Extension tab 32 is connected to edge 66 of bottom tuck panel 34 along score line 33. Bottom panel 36 is connected to wall panel 22 along score line 30, to end panel 38 along score line 52, and to bottom end panel 44 along score line 54. Bottom panel 36 has exposed edges 68 and 68*a*. It should be noted that bottom edge 68*a* could, depending upon the equipment being used to form the carton, be on a continuous straight line with edge 68. Bottom end panel 38 includes triangular end tab 39 and triangular fold-in tabs 40 and 42. Bottom end panel 44 includes triangular end tab 45 and triangular fold-in tabs 46 and 48. Triangular fold-in tabs 40 and 42 are attached to triangular end tab 39 along diagonal score lines 58 and 60, respectively. Triangular fold-in tabs 40 and 42 have exposed edges 70 and 72, respectively. Similarly, triangular fold-in tabs 46 and 48 are attached to triangular end tab 45 along diagonal score lines 62 and 64, respectively. Triangular fold-in tabs 46 and 48 have exposed edges 74 and 76, respectively.

With reference to FIGS. 2 and FIGS. 7–7*b*, carton bottom 80 is created by first folding carton blank 10 (see FIG. 1) in a conventional manner to form the tubular rectangular body 78. With reference to FIGS. 3–7*b*, nonwicking carton bottom 80 is created by folding bottom tuck panel 34 and bottom panel 36 down about score line 30 toward the center of rectangular body 78. At the same time, triangular end tabs 39 and 45 are folded down about score line 30 toward the center of rectangular body 78. Folding triangular end tabs 39 and 45 downward causes triangular fold-in tabs 40, 42, 46 and 48 to be folded downward about diagonal score lines 58, 60, 62, and 64, respectively. This folding causes edge 72 of triangular fold-in tab 42 and edge 74 of triangular fold-in tab 46 to approach bottom panel 36.

With reference to FIGS. 4–5*a*, as bottom tuck panel 34 and bottom panel 36 are folded downward, extension tab 32 is folded upward along score line 33 when edge 68 of bottom panel 36 pushes against the inner surface of extension tab 32. With reference to FIGS. 4–6, in the folding process extension tab 32 is folded under and tucked into the gap left between the ends of triangular end tabs 39 and 45. With reference to FIGS. 7–7*b*, after extension tab 32 is entirely tucked into this gap, edges 68 and 68*a* of bottom panel 36 extend over edge 66 of bottom panel 34 (i.e., the inner surface of bottom panel 36 overlaps the outer surface of bottom tuck panel 34). Bottom panel 36 and bottom tuck panel 34 lie flat, with extension tab 32 sandwiched between them. The only portion of bottom panel 34 which remains exposed in the interior of the carton bottom 80 is the folded surface of extension tab 32, thereby providing a nonwicking closure at the bottom of rectangular, tubular body 78.

Although described in conjunction with a conventional carton having rectangular wall panels, it should be understood that the present invention also is suitable for use, for example, with cartons shaped as sections of round or curved cylinders, square cylinders, rectangular cylinders, and cones and cartons having four trapezoidal shaped wall panels, as well as other carton configurations. The bottom closure 28 of the present invention can be made to accommodate such carton configurations by modifying the shape of bottom tuck panel 34, bottom panel 36, and end panels 38 and 44 accordingly. The relative positions of bottom panel 36 and bottom tuck panel 34 can be interchanged in the carton blank (see FIGS. 1, 8 and 9), so that bottom tuck panel 34 with extension tab 32 can be positioned between bottom end panels 38 and 44, and bottom panel 36 can be positioned at one end of the carton blank, connected on its left side to bottom end panel 38. In addition, extension tab 32 can be of any suitable shape such as, for example, semicircular, trapezoidal, square, rectangular, triangular or curved.

For example, FIG. 8 illustrates an alternative embodiment of the present invention in which the bottom closure 28 has been modified for use with a carton having four trapezoidal wall panels. With reference to FIG. 8, carton blank 10' comprises a conventional top closure panel arrangement and trapezoidal wall panels 20', 22', 24' and 26'. In the embodiment illustrated in FIG. 8 (and also the embodiment illustrated in FIG. 9 described below), wall panel 26' is comprised of a left-hand portion **26*a'* and a right-hand portion 26*b'*. Similarly, in FIG. 8, bottom panel 36' is comprised of right-hand and left-hand portions 36*b'* and 36*a'*, respectively. Carton blank 10' can be folded and sealed along the side seam 18' of wall panel 26' and bottom panel 36' to form a tubular body in substantially the same manner as described above for the embodiment illustrated in FIGS. 1–7*b*. Extension tab 32' is connected to the lower edge of bottom tuck panel 34' along score line 33'. Carton blank 10' in FIG. 8 is similar to carton blank 10 in FIG. 1 except that the panels of the blank in FIG. 8 are trapezoidal rather than rectangular and the positions of the bottom tuck panel 34' and bottom panel 36' are interchanged from the positions of panels 34 and 36 in FIGS. 1–7*b***.

Figure 9:
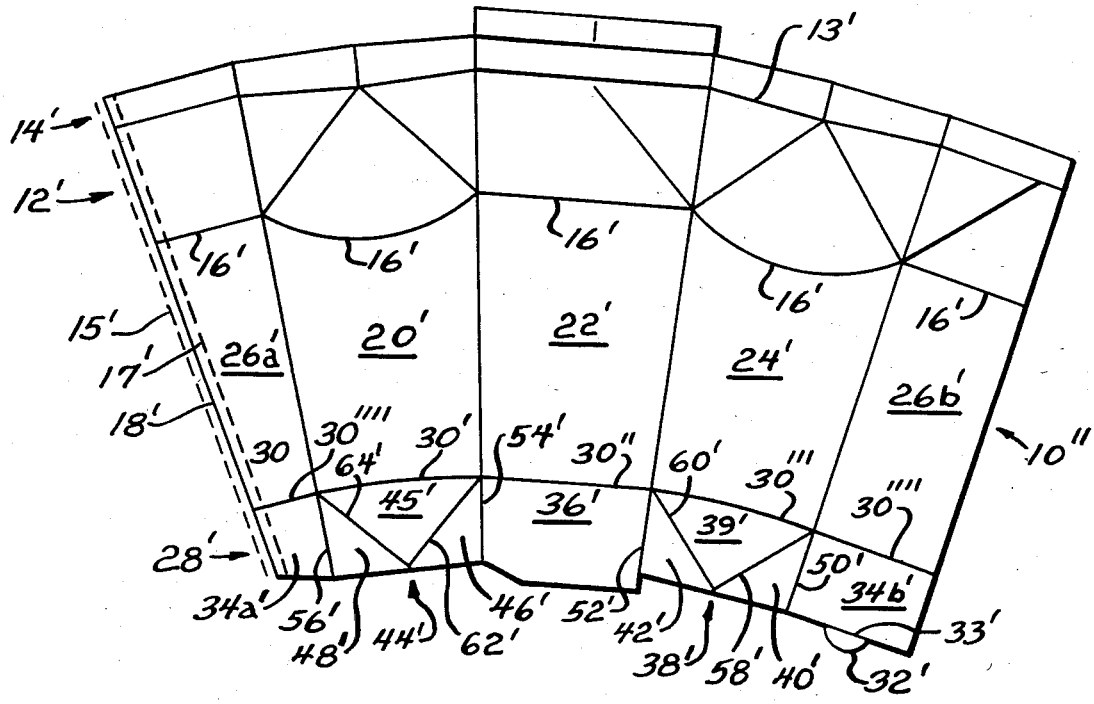
FIG. 9 is a top plan view of the interior of the carton blank of another alternative embodiment of the present invention.

FIG. 9 illustrates another alternative embodiment of the present invention in which the bottom closure 28' has been modified to accomodate wall panel structure that provides a curved rather than rectangular tubular body. With reference to FIG. 9, carton blank 10'' comprises a conventional top closure panel arrangement and substantially trapezoidal wall panels 20', 22', 24' and 26'. Carton blank 10'' is folded and sealed along side seam 18' to form a tubular body in substantially the same manner as described above for the embodiments illustrated in FIGS. 1–8. It should be noted that wall panels 20', 22', 24' and 26' could have various configurations to provide any desired tubular body configuration when folded and sealed. Carton bottom closure 28' is connected to walls 20', 22', 24' and 26' along score lines 30', 30'', 30''' and 30'''', respectively. Bottom end panels 44' and 38' are connected to wall panels 20' and 24', respectively, by curved score lines 30' and 30''', respectively. Bottom tuck panel 34', comprised of portions **34*a'* and 34*b'*, is connected to wall panel 26', comprised of portions 26*a'* and 26*b'*, by straight score line 30'''', and bottom panel 36' is connected to wall panel 22' by straight score line 30''. Carton blank 10'' in FIG. 9 is similar to carton blank 10 in FIG. 1 and carton blank 10' in FIG. 8 except that score lines 30' and 30''' are curved rather than straight, and extension tab 32 is semicircular rather than rectangular. Alternatively, score lines 30'' and 30'''' in carton blank 10'' could be curved and score lines 30' and 30''' could be straight to accommodate wall panel structure providing a different tubular cross-sectional configuration. In other embodiments, score lines 30', 30'', 30'''** can all be curved to accommodate still other wall panel structures.

The bottom closure 28 of the present invention also could be used, for example, with the types of carton blanks illustrated in U.S. Pat. No. 3,294,310 to Miller, et al., U.S. Pat. No. 3,412,922 to Miller, et al., U.S. Pat. No. 4,093,115 to Bachner, et al., U.S. Pat. No. 4,192,446 to Naito, U.S. Pat. No. 4,206,867 to Skjelby, U.S. Pat. No. 4,211,357 to Lisiecki, U.S. Pat. No. 4,281,787 to Hensey, and U.S. Pat. No. 4,394,954 to Lisiecki.

The embodiment disclosed also could be used in connection with cartons of any appropriate size made of any suitable material. It will be appreciated by those skilled in the art that the present invention is not limited to the precise embodiments or methods disclosed. Various additional changes, modifications, and variations could be made in the carton blank, scoring pattern and methods disclosed herein without departing from the scope and spirit of the present invention.

I claim:

1. In a blank of foldable sheet material for a container having top closure panels, tabs, and fold lines for creating a liquid tight closure and first, second, third and fourth wall panels, said wall panels being joined by fold lines along their respective top edges to said top closure panels and tabs and said wall panels being arranged side by side, each joined along a fold line to the panels adjacent to it, one of the wall panels having a side seam sealing arrangement, said wall panels being joined along fold lines at their respective bottom edges to an improved bottom panel arrangement comprising in combination:

first and second end panels each having first, second, third and fourth edges, said first and second end panels being connected along their third edges by fold lines respectively to the bottom edges of said second and fourth wall panels, each of said first and second end panels having a triangular end tab and first and second triangular fold-in tabs, each of said first and second triangular fold-in tabs being connected along a fold line to said triangular end tab;

first and second bottom panels having first, second, third and fourth edges, said first and second bottom panels being connected along their third edges by fold lines respectively to the bottom edges of said first and third wall panels, said first bottom panel being connected along its fourth edge by a fold line to the second edge of said first end panel, said second bottom panel being connected along its second edge by a fold line to the fourth edge of said first end panel and along its fourth edge by a fold line to the second edge of said second end panel, the length of said second bottom panel measured between its first and third edges being longer than the length of said first bottom panel measured between its first and third edges; and an extension tab having an inner edge and an outer edge, said extension tab being connected along its inner edge by a fold line to the first edge of said first bottom panel, said extension tab being narrower in width than the distance between said second and fourth edges of said first bottom panel, and said extension tab protruding out from the first edge of said first bottom panel such that the portion of the first edge of said first bottom panel on either side of said extension tab is closer to said wall panels than the outer edge of said extension tab.

2. An improved bottom panel arrangement as claimed in claim 1 wherein said extension tab extends out from the first edge of said first bottom panel approximately the same distance as the difference in length between the first and third edges of said first bottom panel and said second bottom panel.

3. An improved bottom panel arrangement as claimed in claim 1 wherein the length of the second edge of said second bottom panel is longer than the second and fourth edges of said first bottom panel, and the length of the fourth edge of said second rectangular bottom panel is the same length as the second and fourth edges of said first and second end panels, and wherein the first edge of said second bottom panel includes a first portion parallel to, and a second portion not parallel to, the third edge of said second bottom panel, one end of the first portion being connected to the second edge of said second bottom panel, one end of the second portion being connected to the fourth edge of said second bottom panel, and the other ends of the first and second portions joining to form the first edge of said second bottom panel such that the first edge of said second bottom panel forms a right trapezoidal extension extending beyond the first edges of said first bottom panel and said first and second end panels.

4. An improved bottom panel arrangement as claimed in claim 1 wherein the length of said second bottom panel measured between its first and third edges is longer than one-half the width of each of said first and second end panels measured between their second and fourth edges.

5. An improved bottom panel arrangement as claimed in claim 1 wherein the combined lengths of each of said first and second end panels measured between its first and third edges do not exceed the width of said first and second bottom panels measured between their second and fourth edges.

6. A method of forming a nonwicking liquid-tight carton bottom from a container blank as described in claim 1, comprising:

folding the first, second, third and fourth wall panels into a tubular, rectangular body and sealing the side seam arrangement in the one wall panel;

folding said first and second end panels about their third edges toward the center of the rectangular body, whereby the triangular end tabs of said first and second end panels move toward each other and the center of the rectangular body, while the first and second triangular fold-in tabs of said first and second end panels fold about the fold lines connecting them to the triangular end tab of each of said first and second end panels, respectively, causing the first and second triangular fold-in tabs of said first and second end panels to approach the first and second bottom panels, respectively;

folding said first and second bottom panels along their third edges toward the center of the rectangular body, causing the first edge of said first bottom panel to approach the first edge of said second bottom panel, causing said extension tab to be folded back about the fold line along the first edge of said first bottom panel when the end of said extension tab contacts said second bottom panel near the first edge thereof, causing said folded-back extension tab to be inserted into the opening formed between said first and second end panels, and causing the portion of said second bottom panel near the first edge thereof to protrude over the first edge of said first bottom panel as and when said first and second bottom panels are folded to a flat position; and bonding said folded bottom panels and said folded end panels to form a liquid-tight seal.

7. An improved bottom panel arrangement as claimed in claim 1 wherein said first and second end panels and said first and second bottom panels are rectangular.

8. An improved bottom panel arrangement as claimed in claim 1 wherein said first and second end panels and said first and second bottom panels are trapezoidal.

9. In a blank of foldable sheet material for a container having top closure panels, tabs, and fold lines for creating a liquid tight closure and first, second, third and fourth wall panels, said wall panels being joined by fold lines along their respective top edges to said top closure panels and tabs and said wall panels being arranged side by side, each joined along a fold line to the panels adjacent to it, one of the wall panels having a side seam sealing arrangement, said wall panels being joined along fold lines at their respective bottom edges to an improved bottom panel arrangement comprising in combination:

first and second end panels each having first, second, third and fourth edges, said first and second end panels being connected along their third edges by fold lines respectively to the bottom edges of said second and fourth wall panels, each of said first and second end panels having a triangular end tab and first and second triangular fold-in tabs, each of said first and second triangular fold-in tabs being connected along a fold line to said triangular end tab;

first and second bottom panels having first, second, third and fourth edges, said first and second bottom panels being connected along their third edges by fold lines respectively to the bottom edges of said first and third wall panels, said first bottom panel being connected along its fourth edge by a fold line to the second edge of said first end panel, said second bottom panel being connected along its second edge by a fold line to the fourth edge of said first end panel and along its fourth edge by a fold line to the second edge of said second end panel, the length of said first bottom panel measured between its first and third edges being longer than the length of said second bottom panel measured between its first and third edges; and an extension tab having an inner edge and an outer edge, said extension tab being connected along its inner edge by a fold line to the first edge of said second bottom panel, said extension tab being narrower in width than the distance between said second and fourth edges of said second bottom panel, and said extension tab protruding out from the first edge of said second bottom panel such that the portion of the first edge of said first bottom panel on either side of said extension tab is closer to said wall panels than the outer edge of said extension tab.

10. A container having a tubular body and a bottom closure, wherein said container comprises in combination:

wall panel structure;

first and second end panels each having first, second, third and fourth edges, said first and second end panels being connected along their third edges by fold lines to the bottom of said wall panel structure, said first and second end panels each having a substantially triangular end tab and first and second triangular fold-in tabs, each of said first and second triangular fold-in tabs being connected along a fold line to one side of said substantially triangular end tab;

first and second bottom panels each having first, second, third and fourth edges, said first and second bottom panels being connected along their third edges by fold lines to the bottom of said wall structure, said first bottom panel being connected along its fourth edge by a fold line to the second edge of said first end panel, said second bottom panel being connected along its second edge by a fold line to the fourth edge of said first end panel and along its fourth edge by a fold line to the second edge of said second end panel, said second bottom panel being at least as long between its first and third edges as said first bottom panel between its first and third edges; and an extension tab having an inner edge and an outer edge, said extension tab being connected along its inner edge by a fold line to only a portion of the first edge of said first bottom panel, said extension tab extending beyond the first edge of said first bottom panel such that the portion of the first edge of said first bottom panel on either side of said extension tab is closer to said wall panels than the outer edge of said extension tab.

11. A container having a tubular body and a bottom closure, wherein said container comprises in combination:

wall panel structure;

first and second end panels each having first, second, third and fourth edges, said first and second end panels being connected along their third edges by fold lines to the bottom of said wall panel structure, said first and second end panels each having a substantially triangular end tab and first and second triangular fold-in tabs, each of said first and second triangular fold-in tabs being connected along a fold line to one side of said substantially triangular end tab;

first and second bottom panels each having first, second, third and fourth edges, said first and second bottom panels being connected along their third edges by fold lines to the bottom of said wall structure, said first bottom panel being connected along its fourth edge by a fold line to the second edge of said first end panel, said second bottom panel being connected along its second edge by a fold line to the fourth edge of said first end panel and along its fourth edge by a fold line to the second edge of said second end panel, said first bottom panel being at least as long between its first and third edges as said second bottom panel between its first and third edges; and an extension tab having an inner edge and an outer edge, said extension tab being connected along its inner edge by a fold line to only a portion of the first edge of said second bottom panel, said extension tab extending beyond the first edge of said first bottom panel such that the portion of the first edge of said first bottom panel on either side of said extension tab is closer to said wall panels than the outer edge of said extension tab.

12. A container as claimed in claim 10 or 11 wherein said wall panel structure further comprises four rectangular wall panels arranged side by side, each joined along a fold line to the panels adjacent to it, one of the wall panels having a side seam sealing arrangement and wherein said first and second end panels and said first and second bottom panels are rectangular.

13. A container as claimed in claim 10 or 11 wherein said wall panel structure further comprises four trapezoidal wall panels arranged side by side, each joined along a fold line to the panels adjacent to it, one of the wall panels having a side seam sealing arrangement and wherein said first and second end panels and said first and second bottom panels are trapezoidal.

14. A container as claimed in claim 10 or 11 wherein said wall panel structure defines a section of a cone and wherein the fold lines along which said first and second end panels are connected to said wall structure are arcuate.

15. A container as claimed in claim 10 or 11 wherein said wall panel structure defines a section of a cone and wherein the fold lines along which said first and second bottom panels are connected to said wall structure are arcuate.

16. A container as claimed in claim 10 or 11 wherein said wall panel structure defines a section of a curved cylinder and wherein the fold lines along which said first and second end panels are connected to said wall structure are arcuate.

17. A container as claimed in claim 10 or 11 wherein said wall panel structure defines a section of a curved cylinder and wherein the fold lines along which said first and second bottom panels are connected to said wall structure are arcuate.

* * * * *